US009127679B2

(12) United States Patent
Van Dam et al.

(10) Patent No.: US 9,127,679 B2
(45) Date of Patent: Sep. 8, 2015

(54) COUNTER ROTATING HELICO-AXIAL PUMP

(71) Applicant: General Electric Company, Schenectady, NY (US)

(72) Inventors: Jeremy Daniel Van Dam, West Coxsackie, NY (US); Vittorio Michelassi, Munich (DE); René du Cauze de Nazelle, Munich (DE); Siddharth Navinchandra Ashar, Munich (DE); Haris Ligata, Niskayuna, NY (US)

(73) Assignee: General Electric Company, Niskayuna, NY (US)

( * ) Notice: Subject to any disclaimer, the term of this patent is extended or adjusted under 35 U.S.C. 154(b) by 461 days.

(21) Appl. No.: 13/688,613

(22) Filed: Nov. 29, 2012

(65) Prior Publication Data

US 2014/0147253 A1 May 29, 2014

(51) Int. Cl.

| | |
|---|---|
| ***F04D 3/00*** | (2006.01) |
| ***F04D 13/02*** | (2006.01) |
| ***F04D 19/02*** | (2006.01) |
| ***F04D 25/02*** | (2006.01) |

(52) U.S. Cl.

CPC ..... *F04D 3/00* (2013.01); *F04D 13/028* (2013.01); *F04D 19/024* (2013.01); *F04D 25/028* (2013.01)

(58) Field of Classification Search

CPC ..... F04D 3/00; F04D 13/028; F04D 19/024; F04D 25/028

See application file for complete search history.

(56) References Cited

U.S. PATENT DOCUMENTS

| | | | | |
|---|---|---|---|---|
| 3,385,509 | A | | 5/1968 | Gamier |
| 4,159,624 | A | * | 7/1979 | Gruner ..... 60/39.183 |
| 5,010,729 | A | * | 4/1991 | Adamson et al. ..... 60/226.1 |
| 5,030,149 | A | | 7/1991 | Fujita |
| 5,079,916 | A | * | 1/1992 | Johnson ..... 60/268 |
| 5,618,213 | A | | 4/1997 | Nanami |
| 5,634,831 | A | | 6/1997 | Davies et al. |
| 6,193,569 | B1 | | 2/2001 | Davies et al. |

(Continued)

FOREIGN PATENT DOCUMENTS

GB 587529 A 4/1947

OTHER PUBLICATIONS

PCT Search Report and Written Opinion dated Jan. 28, 2014 from corresponding Application No. PCT/US2013/067937.

(Continued)

*Primary Examiner* — Igor Kershteyn
(74) *Attorney, Agent, or Firm* — Andrew J. Caruso

(57) ABSTRACT

A counter rotating helico-axial pump is provided, the pump comprising: (a) an inner rotor comprising a plurality of outwardly extending helico-axial impeller vanes; (b) a hollow outer rotor comprising a plurality of inwardly extending helico-axial impeller vanes; (c) a single driving device configured to drive the inner rotor or the hollow outer rotor; and (d) a force transmission coupling joining the inner rotor and the hollow outer rotor and configured to permit rotation of the inner rotor and hollow outer rotor in opposite directions; wherein at least a portion of the inner rotor is disposed within the hollow outer rotor, and wherein the inner rotor, the hollow outer rotor and the helico-axial impeller vanes define a fluid flow path, and wherein the inner rotor and hollow outer rotor are configured such that at least some of adjacent helico-axial impeller vanes are configured to rotate in opposite directions.

21 Claims, 11 Drawing Sheets

(56) References Cited

U.S. PATENT DOCUMENTS

| | | | | |
|---|---|---|---|---|
| 6,273,768 | B1 | 8/2001 | Blanchard | |
| 6,663,448 | B1 | 12/2003 | Davies et al. | |
| 7,824,237 | B2 | 11/2010 | Paterson et al. | |
| 7,950,220 | B2 * | 5/2011 | Merry et al. | 60/268 |
| 2009/0042464 | A1 | 2/2009 | O'Connor | |
| 2011/0074158 | A1 | 3/2011 | Schroeder | |

OTHER PUBLICATIONS

Kanemoto et al., "Smart Control of Axial Flow Pump Performance by Means of Counter-Rotation", JSME International Journal, Series B, vol. 45, No. 2, pp. 293-300, 2002.

Tsui at al., "Flow Characteristics in Mixers Agitated by Helical Ribbon Blade Impeller", Engineering Applications of Computational Fluid Mechanics, vol. 5, Issue 3, pp. 416-429, 2011.

* cited by examiner

COUNTER ROTATING HELICO-AXIAL PUMP

BACKGROUND

The present invention relates to counter rotating helico-axial pumps. In particular, the present invention relates to counter rotating helico-axial pumps comprising a single driving device.

Counter rotating helico-axial pumps are known and are useful in both science and commerce, and are prized for their reliability and robustness when pumping fluids. Known counter rotating helico-axial pumps employ at least two motors to generate the counter-rotatory motion of two sets of helico-axial impeller vanes; a first set of helico-axial impeller vanes being driven by a first motor, and second set of helico-axial impeller vanes being driven by a second motor. The use of two motors, while enabling the required counter-rotatory motion of two sets of helico-axial impeller vanes, is problematic in that it restricts design options and builds the cost of two motors into such counter rotating helico-axial pumps. Thus, there is a need for additional improvements in the field of counter rotating helico-axial pumps.

BRIEF DESCRIPTION

In one embodiment, the present invention provides a counter rotating helico-axial pump comprising: (a) an inner rotor comprising a plurality of outwardly extending helico-axial impeller vanes; (b) a hollow outer rotor comprising a plurality of inwardly extending helico-axial impeller vanes; (c) a single driving device configured to drive the inner rotor or the hollow outer rotor; and (d) a force transmission coupling joining the inner rotor and the hollow outer rotor and configured to permit rotation of the inner rotor and hollow outer rotor in opposite directions; wherein at least a portion of the inner rotor is disposed within the hollow outer rotor, and wherein the inner rotor, the hollow outer rotor and the helico-axial impeller vanes define a fluid flow path, and wherein the inner rotor and hollow outer rotor are configured such that at least some of adjacent helico-axial impeller vanes are configured to rotate in opposite directions.

In another embodiment, the present invention provides a counter rotating helico-axial pump comprising: (a) an inner rotor comprising one or more outwardly extending helico-axial impeller vanes; (b) a hollow outer rotor comprising one or more inwardly extending helico-axial impeller vanes; (c) a single driving device configured to drive the inner rotor or the hollow outer rotor; and (d) a force transmission coupling joining the inner rotor and the hollow outer rotor and configured to permit rotation of the inner rotor and hollow outer rotor in opposite directions; wherein at least a portion of the inner rotor is disposed within the hollow outer rotor, and wherein the inner rotor, the hollow outer rotor and the helico-axial impeller vanes define a fluid flow path, and wherein the inner rotor and hollow outer rotor are configured such that at least some of adjacent helico-axial impeller vanes are configured to rotate in opposite directions, and wherein the inner rotor, the hollow outer rotor are disposed within a pump housing.

In yet another embodiment, the present invention provides a counter rotating helico-axial pump comprising: (a) an inner rotor comprising one or more outwardly extending helico-axial impeller vanes; (b) a hollow outer rotor comprising one or more inwardly extending helico-axial impeller vanes; (c) a single motor configured to drive the inner rotor; and (d) a force transmission coupling mechanically joining the inner rotor and the hollow outer rotor and configured to drive the hollow outer rotor in a direction of rotation opposite that of the inner rotor; wherein at least a portion of the inner rotor is disposed within the hollow outer rotor, and wherein the inner rotor, the hollow outer rotor and the helico-axial impeller vanes define a fluid flow path, and wherein the inner rotor and hollow outer rotor are configured such that adjacent helico-axial impeller vanes are configured to rotate in opposite directions, and wherein the inner rotor, the hollow outer rotor, and the motor are disposed within a pump housing having an axial fluid inlet and an axial fluid outlet.

BRIEF DESCRIPTION OF THE DRAWING FIGURES

Various features, aspects, and advantages of the present invention will become better understood when the following detailed description is read with reference to the accompanying drawings in which like characters may represent like parts throughout the drawings. Unless otherwise indicated, the drawings provided herein are meant to illustrate key inventive features of the invention. These key inventive features are believed to be applicable in a wide variety of systems comprising one or more embodiments of the invention. As such, the drawings are not meant to include all conventional features known by those of ordinary skill in the art to be required for the practice of the invention.

DETAILED DESCRIPTION

Figure 1:
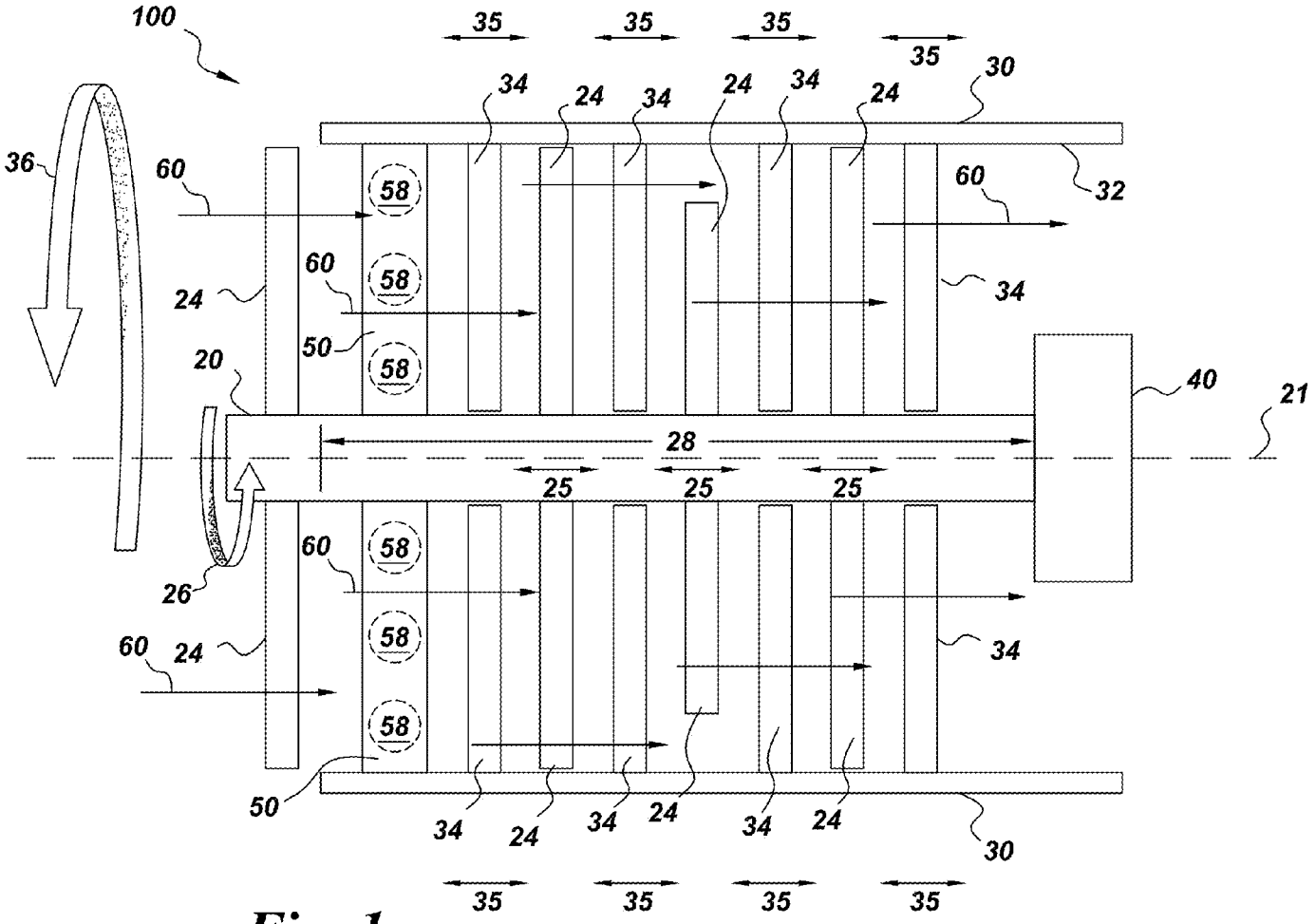
FIG. 1 illustrates a counter rotating helico-axial pump according to one or more embodiments of the present invention.

In the following specification and the claims, which follow, reference will be made to a number of terms, which shall be defined to have the following meanings.

The singular forms "a", "an", and "the" include plural referents unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about" and "substantially", are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

As noted, in one embodiment, the present invention provides a counter rotating helico-axial pump comprising (a) an inner rotor comprising one or more outwardly extending helico-axial impeller vanes; (b) a hollow outer rotor comprising one or more inwardly extending helico-axial impeller vanes; (c) a single driving device configured to drive the inner rotor or the hollow outer rotor; and (d) a force transmission coupling joining the inner rotor and the hollow outer rotor and configured to permit rotation of the inner rotor and hollow outer rotor in opposite directions; wherein at least a portion of the inner rotor is disposed within the hollow outer rotor, and wherein the inner rotor, the hollow outer rotor and the helico-axial impeller vanes define a fluid flow path, and wherein the inner rotor and hollow outer rotor are configured such that at least some of adjacent helico-axial impeller vanes are configured to rotate in opposite directions.

As noted, in various embodiments, the counter rotating helico-axial pump provided by the present invention comprises two rotors, an inner rotor at least a portion of which is disposed within a hollow outer rotor. The counter rotating helico-axial pump comprises a single driving device which drives one of the two rotors as a "driven" rotor, which "driven" rotor is coupled to and drives the other rotor. The driving device can be a motor (e.g. an electric motor), an engine, turbine, a spring, or a flywheel, to name a representative but non-limiting examples.

In one or more embodiments the single driving device drives the inner rotor which in turn drives the hollow outer rotor via a force transmission coupling. In an alternate set of embodiments, the single driving device drives the hollow outer rotor which in turn drives the inner rotor via the force transmission coupling.

As will be appreciated by those of ordinary skill in the art, the rotor driven by the single driving device (the driven rotor) is joined to the other rotor via a force transmission coupling which transfers force from the driven rotor to the other rotor and causes it to rotate in a direction opposite that of the driven rotor. The nature of the force transmission coupling is such that it may mechanically join the two rotors, or may magnetically join the two rotors. Examples of suitable force transmission couplings which may be used to mechanically join the driven rotor with the other rotor include planetary gear assemblies, bevel gear differential assemblies, belt and gear assemblies, and spur gear differential assemblies. Examples of suitable force transmission couplings which may be used to magnetically join the driven rotor with the other rotor include magnetic gearbox assemblies. Magnetic gearbox assemblies are known in the art.

In various embodiments, the counter rotating helico-axial pump provided by the present invention comprises an inner rotor disposed within a hollow outer rotor, the inner rotor comprising a first set of outwardly extending helico-axial impeller vanes, the hollow outer rotor comprising a second set of inwardly extending helico-axial impeller vanes. Those of ordinary skill in the art will appreciate that such impeller vanes are disposed helically along an axis defined by the inner rotor and the hollow outer rotor and that the two sets of impeller vanes are, in certain embodiments, designed to intermesh such that at least some of adjacent impeller vanes rotate in opposite directions during operation. In one or more embodiments, the first set of outwardly extending impeller vanes comprises one or more outwardly extending impeller vane subsets, which subsets may comprise one or more adjacent, co-rotatory helico-axial impeller vanes. Likewise, in one or more embodiments, the second set of inwardly extending impeller vanes comprises one or more inwardly extending impeller vane subsets, which subsets may comprise more than one adjacent, co-rotatory helico-axial impeller vanes.

Rotors and impeller vanes used according to one or more embodiments of the present invention may be made of any suitable material or materials, such as metals, ceramics, composite materials, plastics, and filled plastics. In one embodiment, the rotors and vanes are made of metal, for example stainless steel and aluminum. In another embodiment, the rotors are made of metal and the vanes are made of a plastic material such as a filled polyether imide.

Rotors comprising one or more outwardly extending helico-axial impeller vanes may be prepared by a variety of techniques. In the case of the inner rotor, for example, the outwardly extending helico-axial impeller vanes may be attached as one or more outer sleeves comprising one or more outwardly extending impeller vanes and heat shrinking the sleeve around a substrate rotor (i.e. heating the sleeve to a temperature above the rotor's projected highest use temperature and inserting the substrate rotor into the hot sleeve and thereafter allowing the assembly of substrate rotor and sleeve to cool). A similar scheme may be used to attach the inwardly extending helico-axial impeller vanes to a hollow outer rotor by heat shrinking a substrate hollow outer rotor onto an inner sleeve comprising inwardly extending helico-axial impeller vanes. Alternatively, the rotors comprising one or more helico-axial impeller vanes may be cast, or machined from a single piece of material, such as a metal cylinder. Other techniques may also be used, for example fixing a portion of the helico-axial impeller vane into a slot recessed into the surface of the rotor, the slot having a helico-axial shape and dimensions complementing the impeller vane for a secure fit between rotor and impeller vane. Under such circumstances, shrinking a hot rotor around a portion of a helico-axial impeller vane inserted in a slot recessed into, or even traversing, the rotor may be employed advantageously. In one embodiment, the impeller vanes are attached to the rotor by coupling one or more surface projections, for example one or more pins, on the surface of the helico-axial impeller vane in contact with the surface of the rotor, the rotor comprising one or more complementary structures, for example one or more holes, which receive the impeller vane projections. In one or more embodiments, the impeller vanes may be attached to the rotors by a process comprising one or more welding steps.

In one or more embodiments, the present invention provides a counter rotating helico-axial pump which does not comprise a pump housing. Such pumps may be useful in in-line applications wherein the counter rotating helico-axial pump is disposed within a pipe or well bore. Bumper bearings attached to the outside of the hollow outer rotor may be used to align and secure the counter rotating helico-axial within the pipe or well bore while permitting the hollow outer rotor to rotate freely at one or more defined distances from the pipe or well bore wall.

In one or more alternate embodiments, the present invention provides a counter rotating helico-axial pump which comprises a pump housing. In such embodiments, the housing typically comprises a fluid inlet and a fluid outlet and encloses the pumping section defined by the inner rotor and the hollow outer rotor and associated helico-axial impeller vanes. The single driving device may be located within the housing in certain embodiments, and be located outside of the housing in other embodiments. In one or more embodiments, the housing comprises an axial fluid inlet and an axial fluid outlet.

Turning now to the figures and referring to FIG. 1, the figure represents a counter rotating helico-axial pump 100 comprising an inner rotor 20 having a rotor and pump axis of rotation 21, and inner rotor surface 22. Inner rotor 20 comprises one or more outwardly extending helico-axial impeller vanes 24 in each of zones 25 along the length of the inner rotor. Inner rotor 20 is disposed within a hollow outer rotor 30 having an inner surface 32. Hollow outer rotor 30 comprises one or more inwardly extending impeller vanes 34 in each of zones 35 along the length of the hollow outer rotor. Although the figure shows a single helico-axial impeller vane 24 or 34 disposed in each of zones 25 and 35 respectively, it should be noted that each zone 25 and 35 may comprise one or more co-rotatory impeller vanes 24 or 34, a single impeller vane being shown for purposes of convenience. Thus each zone 25 may comprise a subset of the totality of outwardly extending helico-axial impeller vanes comprised by inner rotor 20. This totality of outwardly extending helico-axial impeller vanes 24 is at times herein referred to as the first set of impeller vanes. Helico-axial impeller vanes within a zone 25 or 35 are co-rotatory. Helico-axial impeller vanes in zones 25 are counter-rotatory to helico-axial impeller vanes in zones 35. Because two adjacent impeller vanes may be configured such that a first of the two vanes is in zone 25, and a second of the two vanes is in zone 35, two such adjacent impeller vanes will be counter-rotatory.

In the embodiment shown in FIG. 1, inner rotor 20 is driven by a single driving device 40, and rotates in direction 26. Those of ordinary skill in the art will understand that single driving device 40 may be supported and held in position by a support structure (not shown) attached to, for example a pump housing. Force transmission coupling 50 joins driven inner rotor 20 to hollow outer rotor 30 and causes hollow outer rotor 30 to rotate in direction 36, which is opposite direction 26. In addition, force transmission coupling may serve to support inner rotor 20 within hollow outer rotor 30. In the embodiment shown, a portion 28 of inner rotor 20 is shown as disposed within hollow outer rotor 30 and a portion of inner rotor 20 is shown as disposed outside of hollow outer rotor 30. Inner rotor 20, hollow outer rotor 30 and helico-axial impeller vanes 24 and 34 define an axial fluid flow path 60 through which, during operation, a working fluid is impelled by the action of the counter rotating helico-axial impeller vanes. It should be noted that force transmission coupling 50 permits passage of the working fluid and is designed to minimize the obstruction of fluid flow through the hollow outer rotor. Thus, in general, a force transmission coupling in a counter rotating helico-axial pump which joins an inner rotor to a hollow outer rotor, defines openings 58 through which a working fluid may pass.

Figure 2:
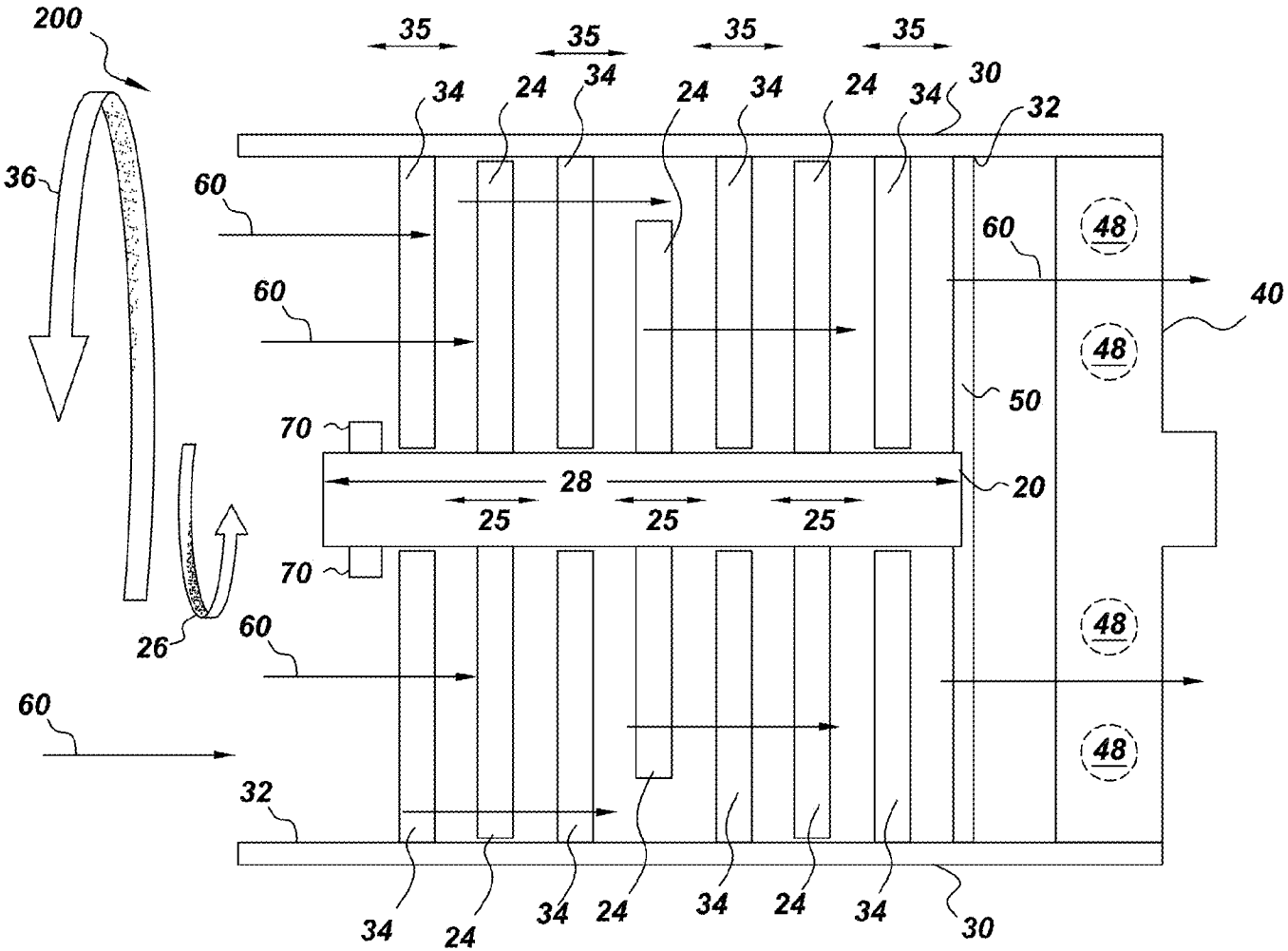
FIG. 2 illustrates a counter rotating helico-axial pump according to one or more embodiments of the present invention.

Referring to FIG. 2, the figure represents a counter rotating helico-axial pump 200 comprising an inner rotor 20 disposed within a hollow outer rotor 30. Inner rotor 20 comprises outwardly extending helico-axial impeller vanes 24 which intermesh with a set of inwardly extending helico-axial impeller vanes 34 of hollow outer rotor 30. As noted in the description of FIG. 1, outwardly extending helico-axial impeller vanes 24 are represented as a single vane in a zone 25 representing a portion of the inner rotor 20. This is done for reasons of convenience only, and each zone 25 may in fact comprise one or more outwardly extending helico-axial impeller vanes 24. Likewise, inwardly extending helico-axial impeller vanes 34 are represented as a single vane in a zone 35 representing a portion of the hollow outer rotor 30. Again, this is done for reasons of convenience only, and each zone 35 may in fact comprise one or more inwardly extending helico-axial impeller vanes 34. In the embodiment shown a single driving device 40 is configured to drive hollow outer rotor 30, the "driven" rotor in this instance. Force transmission coupling 50 joins hollow outer rotor 30 to inner rotor 20 such that the two rotors rotate in opposite directions. In the embodiment shown, a bearing 70 supports the inner rotor at one end. In one or more alternate embodiments, bearing 70 is supported by a structural member (not shown) attached to the interior surface 32 of the hollow outer rotor. In the embodiment shown, both the single driving device 40 and the force transmission coupling 50 define passages (elements 48 and 58 respectively) for the working fluid (not shown) to pass through during operation of the counter rotating helico-axial pump.

Figure 3:
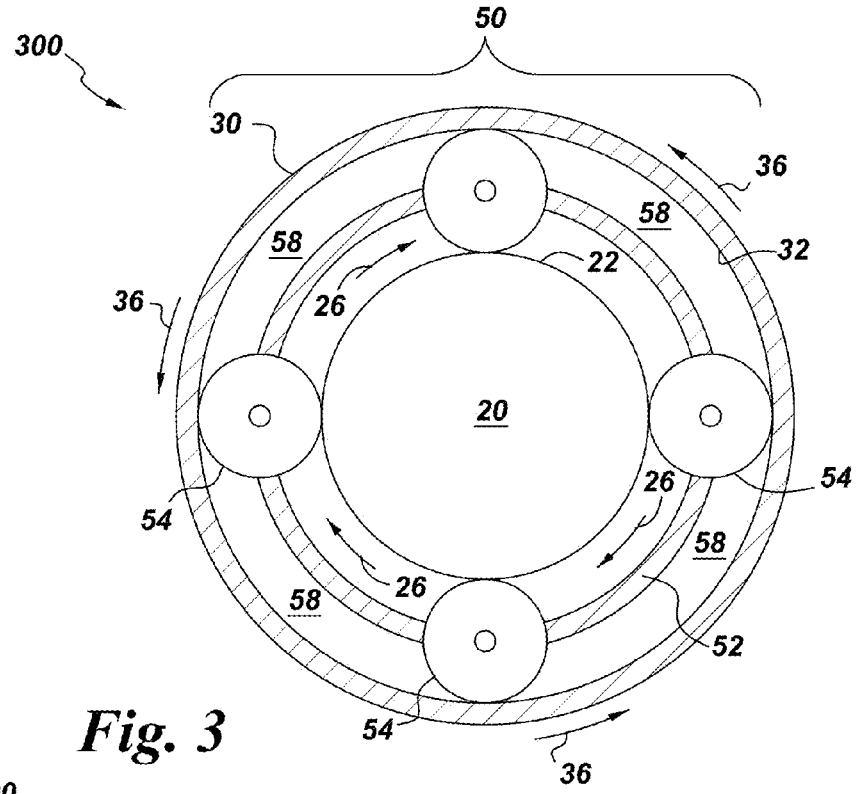
FIG. 3 illustrates a counter rotating helico-axial pump according to one or more embodiments of the present invention.

One such force transmission coupling 50 is shown in FIG. 3 in a cross-sectional view of a counter rotating helico-axial pump 300. In the embodiment shown, the pump comprises an inner rotor 20 comprising outwardly extending helico-axial impeller vanes 24 (not shown in FIG. 3) disposed within a hollow outer rotor 30 comprising inwardly extending helico-axial impeller vanes 34 (not shown in FIG. 3). The force transmission coupling 50 is a planetary gear assembly comprising a "planet carrier" structure 52 and four planetary gears 54 ("planets") which couple to both the inner rotor 20, which serves as the "sun" gear, and the hollow outer rotor 30 which serves as the "ring" gear of the planetary gear assembly. The surfaces 22 and 32 of the inner rotor and hollow outer rotor may be equipped with intermeshing teeth (not shown) to more effectively transfer force from the rotor driven by the single driving device (the driven rotor) to the other rotor. In the embodiment shown, inner rotor 20 is configured to rotate in direction 26 while hollow outer rotor is configured to rotate in direction 36, opposite the direction of rotation of inner rotor 20. Those of ordinary skill in the art will understand that the planetary gear assembly shown defines flow passages 58 which are part of axial flow path 60 of the counter rotating helico-axial pump.

Figure 4:
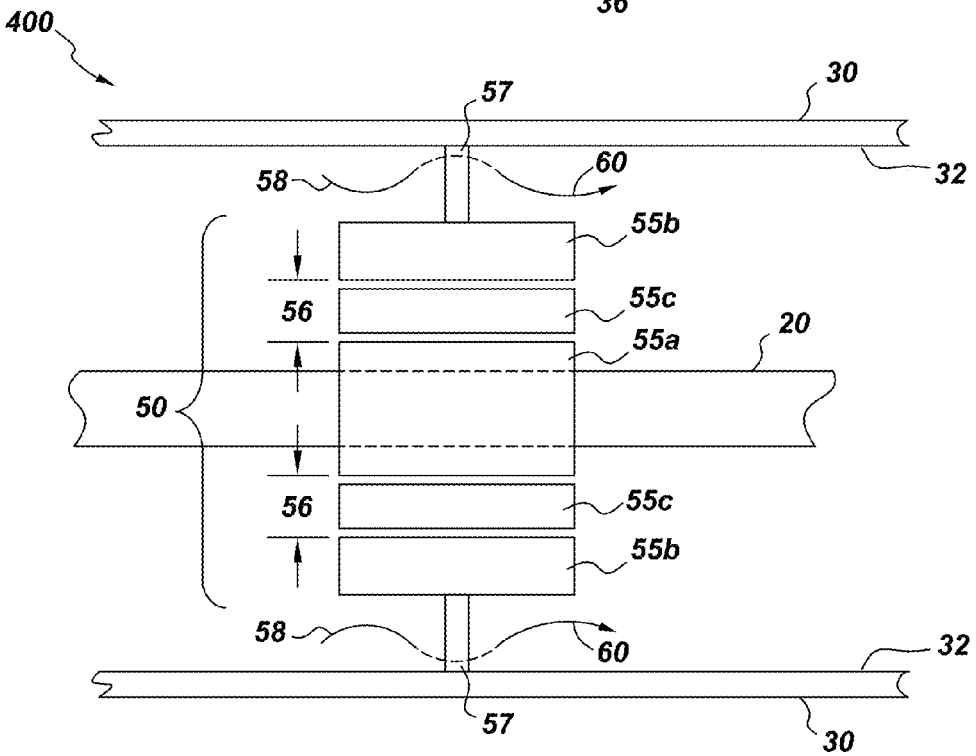
FIG. 4 illustrates a counter rotating helico-axial pump according to one or more embodiments of the present invention.

Referring to FIG. 4, the figure represents a portion of a counter rotating helico-axial pump 400 comprising force transmission coupling 50 which is a magnetic gearbox type coupling. Such couplings are known to those of ordinary skill in the art. In the embodiment shown, the magnetic gearbox comprises a first sleeve 55*a* comprising a first set of permanent magnet poles (not shown) which sleeve is coupled to inner rotor 20. A second sleeve 55*b* comprising a second set of permanent magnet poles (not shown) is coupled by struts 57 to the interior surface 32 of hollow outer rotor 30 such that a flow passage 58 is defined between the interior surface 32 of the hollow outer rotor and the second sleeve 55*b*, and apart from the support struts the flow passage is unobstructed. In various embodiments, the flow passage 58 forms a part of an axial flow path 60. Those of ordinary skill in the art will understand that the first sleeve 55*a* co-rotates with the inner rotor 20 and the second sleeve 55*b* co-rotates with hollow outer rotor 30. The magnetic gearbox coupling further comprises a set of stationary pole pieces 55*c* which are disposed within the gap 56 between the first sleeve 55*a* and the second sleeve 55*b*. Stationary pole pieces may be supported by means know to those of ordinary skill in the art, for example by means of a support structure (not shown) attached to both the stationary pole piece and a stationary wall of the pump housing.

Figure 5:
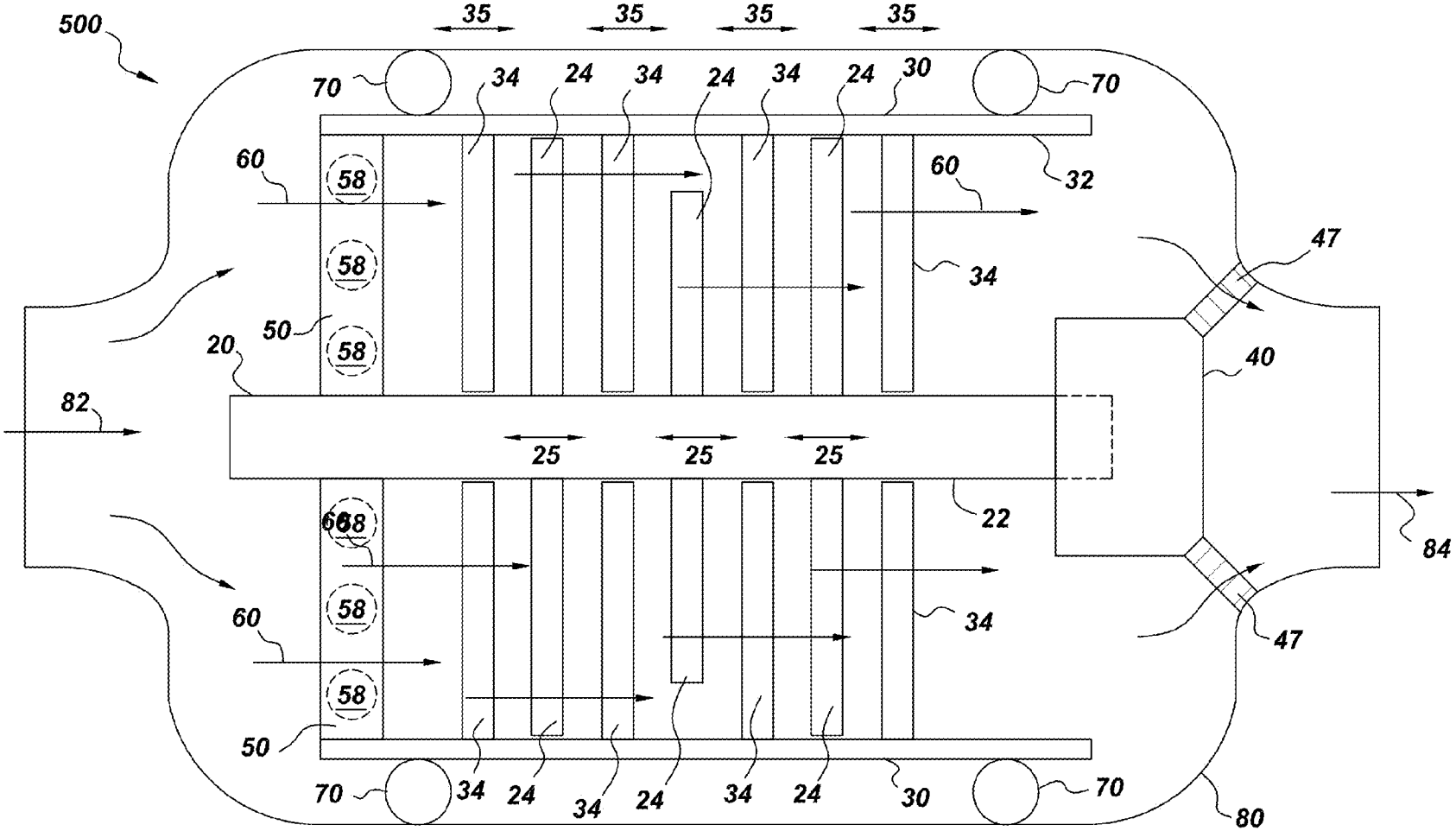
FIG. 5 illustrates a counter rotating helico-axial pump according to one or more embodiments of the present invention.

Referring to FIG. 5, the figure represents a counter rotating helico-axial pump 500 comprising an inner rotor 20 comprising one or more outwardly extending helico-axial impeller vanes 24; a hollow outer rotor 30 comprising one or more inwardly extending helico-axial impeller vanes 34; a single driving device 40 configured to drive the inner rotor 20; and a force transmission coupling 50 joining the inner rotor and the hollow outer rotor and configured to permit rotation of the inner rotor and hollow outer rotor in opposite directions. As noted in the description of FIG. 1 and FIG. 2., outwardly extending helico-axial impeller vanes 24 are represented as a single vane in a zone 25 representing a portion of the inner rotor 20. This is done for reasons of convenience only, and each zone 25 may in fact comprise one or more outwardly extending helico-axial impeller vanes 24. Likewise, inwardly extending helico-axial impeller vanes 34 are represented as a single vane in a zone 35 representing a portion of the hollow outer rotor 30. Again, this is done for reasons of convenience only, and each zone 35 may in fact comprise one or more inwardly extending helico-axial impeller vanes 34. The inner rotor 20 and its outer surface 22, the hollow outer rotor 30 and its interior surface 32, the helico-axial impeller vanes 24 and 34, the driving device 40, and the force transmission coupling 50 define a fluid flow path through the cavity 33 defined by the hollow outer rotor. In the embodiment shown, helico-axial impeller vanes 24 and 34 are configured to rotate in opposite directions. In the embodiment shown, the inner rotor, the hollow outer rotor and the single driving device are disposed within a pump housing 80 defining an axial fluid inlet 82 and an axial fluid outlet 84. In the embodiment shown, bearings 70 support the hollow outer rotor 30 while permitting it to rotate within the housing. In one or more embodiments (not shown in FIG. 5) inner rotor 20 is similarly supported by bearings in contact with the inner wall of the housing and the outer surface 22 of inner rotor 20. In addition, in one or more embodiments, single driving device 40 is an electric motor which is supported by housing wall-mounted struts 47.

Figure 6:
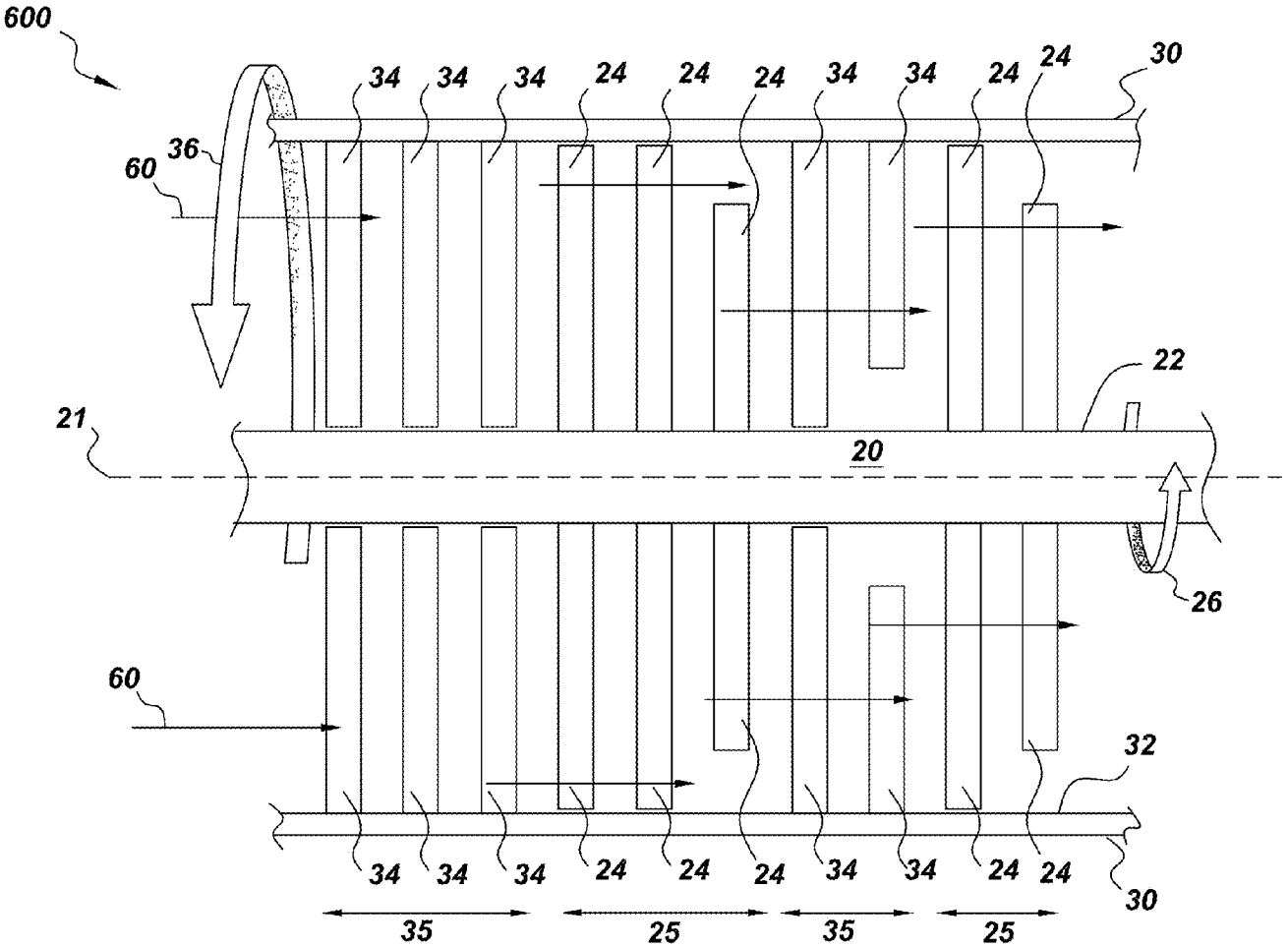
FIG. 6 illustrates a counter rotating helico-axial pump according to one or more embodiments of the present invention.

Referring to FIG. 6, the figure represents a counter rotating helico-axial pump 600 provided by the present invention wherein at least some of adjacent helico-axial impeller vanes are configured to rotate in opposite directions (counter-rotatory), and at least some of adjacent helico-axial impeller vanes are configured to rotate in the same direction (co-rotatory). It should be noted that in systems in which each single outwardly extending helico-axial impeller vane 24 is adjacent only to one or more inwardly extending helico-axial impeller vanes 34, and no two inwardly extending vanes 34 are themselves adjacent, no adjacent impeller vanes will be co-rotatory. In the embodiment shown inner rotor 20 comprises adjacent helico-axial impeller vanes 24 which are configured to be co-rotatory in direction 26. At least some of helico-axial impeller vanes 24 are adjacent to helico-axial impeller vanes 34 and are counter-rotatory with respect to vanes 34 which are configured to rotate in direction 36. Again, as noted in the description of FIG. 1 and elsewhere herein, outwardly extending helico-axial impeller vanes are represented as single vane structures disposed within zones 25 representing axial portions of the inner rotor 20. This is done for reasons of convenience only, and each outwardly extending helico-axial impeller vane structure shown may in fact represent one or more outwardly extending helico-axial impeller vanes 24. Likewise, inwardly extending helico-axial impeller vanes 34 are represented as single vanes disposed within zones 35 representing axial portions of the hollow outer rotor 30. Again, this is done for reasons of convenience only, and each inwardly extending helico-axial impeller vane structure shown may in fact represent one or more inwardly extending helico-axial impeller vanes 34.

Figure 7:
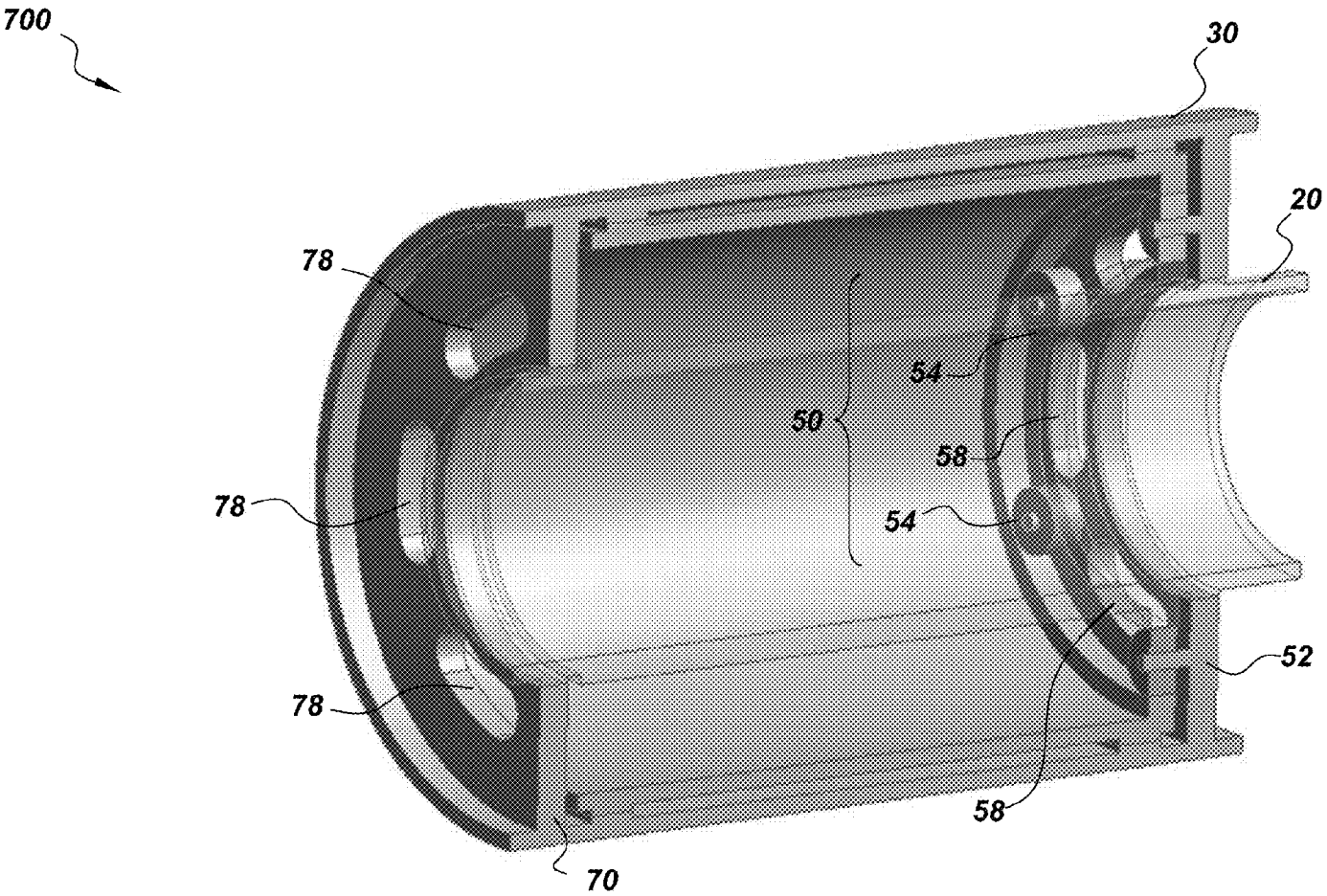
FIG. 7 illustrates a counter rotating helico-axial pump subassembly according to one or more embodiments of the present invention.

Referring to FIG. 7, the figure represents a three-dimensional view in cross section of a subassembly 700 comprising an inner rotor 20 disposed within an hollow outer rotor 30 of a counter rotating helico-axial pump provided by the present invention. In the embodiment shown, a force transmission coupling 50 which is a planetary gear assembly is present. In the embodiment shown, the planetary gear assembly comprises a "planet carrier" structure 52 and a plurality planetary gears 54 ("planets"). In the embodiment shown, support structure 52 defines openings 58 which are part of an axial flow path 60 (not shown) through which a working fluid may be impelled by helico-axial impeller vanes 24 and 34 (not shown) during operation. In the embodiment shown, support bearing 70 is illustrated and defines fluid passages 78 through which a working fluid may pass during operation. It should be noted that the helico-axial impeller vanes 24 and 34 are not shown in order to allow other features of the subassembly 700 to be seen more clearly.

Figure 8:
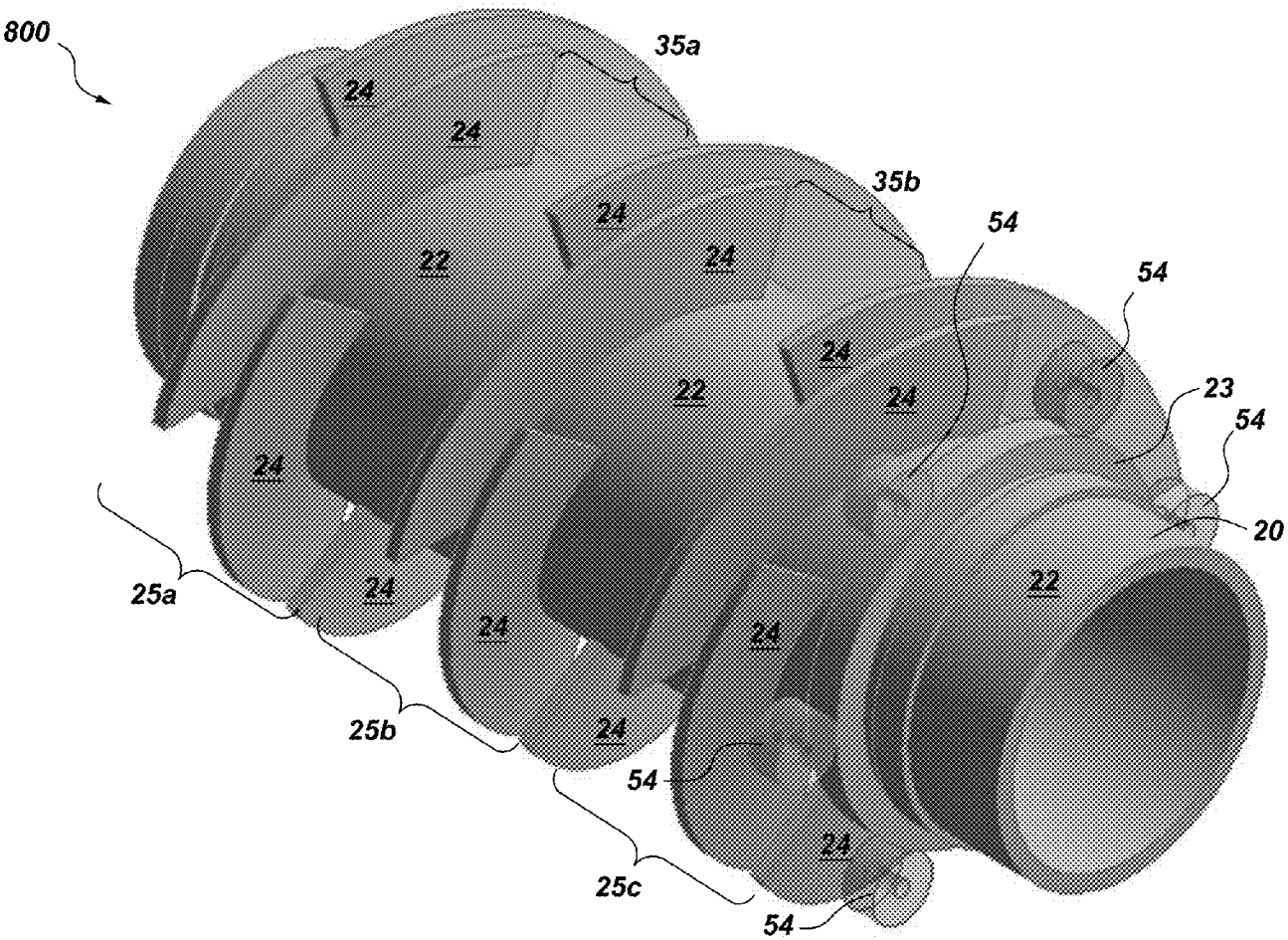
FIG. 8 illustrates a counter rotating helico-axial pump subassembly according to one or more embodiments of the present invention.

Referring to FIG. 8, the figure represents a subassembly 800 provided by the present invention comprising an inner rotor 20 having an outer surface 22 and helico-axial impeller vanes 24 together with a plurality of planetary gears 54, but not showing a planet carrier structure in order to illustrate more plainly other aspects of the embodiment. In the embodiment shown, the planetary gears transfer force to (or from) inner rotor 20 through raised structure 23 which may be integral to inner rotor 20 or appended to it. Both raised structure 23 and planetary gears 54 are advantageously equipped with intermeshing teeth (not shown). At times herein, a subassembly such as 800 may be referred to as an inner impeller.

FIG. 8 further illustrates in a three dimensional view, additional aspects of the present invention. For example, subassembly 800 comprises three zones labeled 25*a*, 25*b*, and 25*c*, each zone being defined by an axial portion of inner rotor 20, and each of zones 25*a*, 25*b* and 25*c* comprising four separate outwardly extending helico-axial impeller vanes 24. Within a zone, for example zone 25*a*, the four outwardly extending helico-axial impeller vanes 24 constitute a subset of a set of twelve outwardly extending helico-axial impeller vanes which a counter rotating helico-axial pump comprising subassembly 800 would contain. Subassembly 800 is configured to intermesh with a set of inwardly extending helico-axial impeller vanes 34 of a hollow outer rotor 30 (See FIG. 9) in the gap (35*a*) between zones 25*a* and 25*b*, and the gap (35*b*) between zone 25*b* and zone 25*c*.

Figure 9:
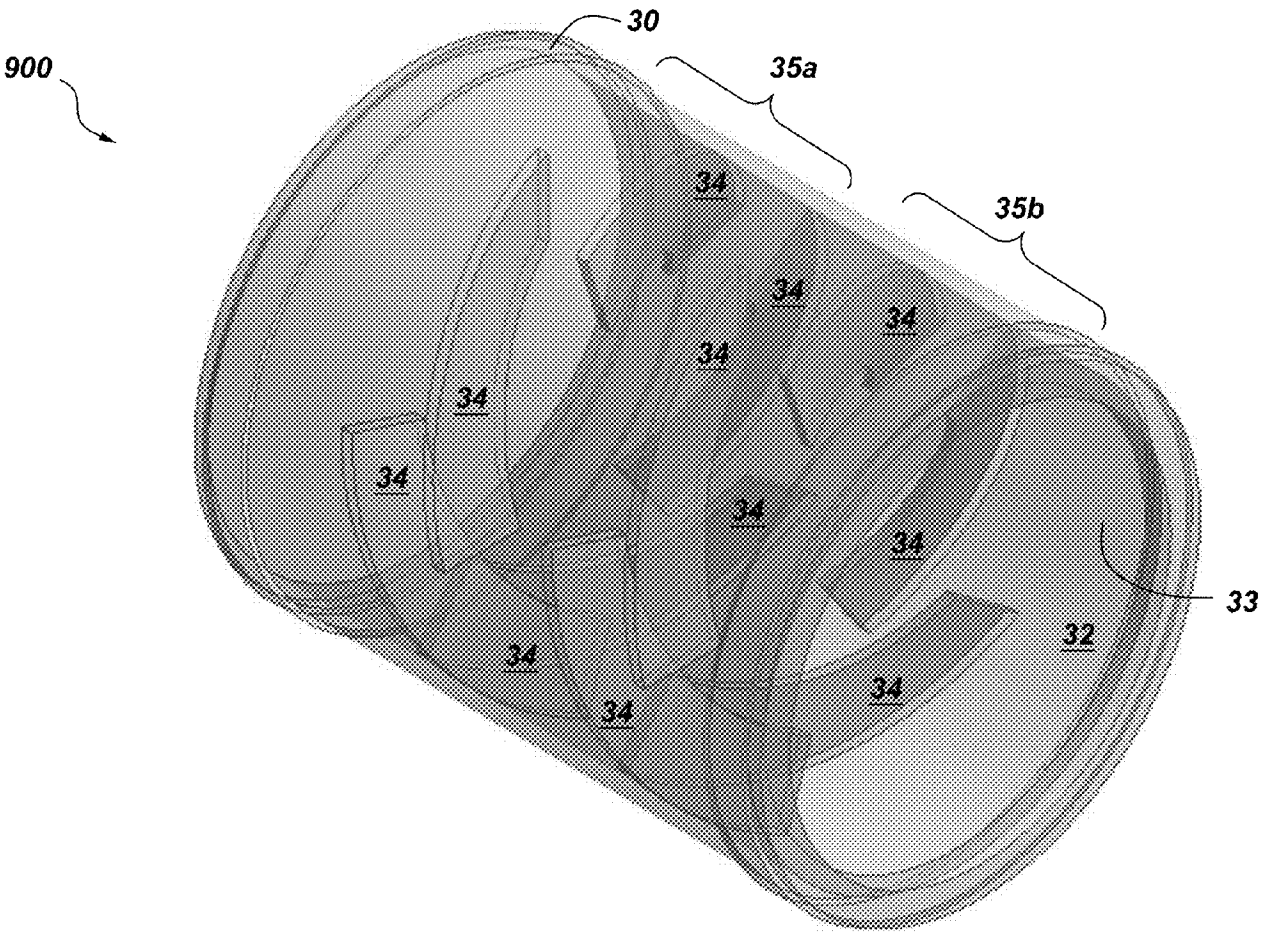
FIG. 9 illustrates a counter rotating helico-axial pump subassembly according to one or more embodiments of the present invention.

Referring to FIG. 9, the figure represents a three dimensional view 900 of a hollow outer rotor 30 equipped with inwardly extending helico-axial impeller vanes 34. At times herein, a hollow outer rotor 30 such as that shown in view 900 may be referred to as an outer impeller. The representation in FIG. 9 is of special value as it provides additional insights into the challenges associated with assembling the counter rotating helico-axial pumps provided by the present invention. Thus, while creating intermeshing subassemblies of inwardly extending helico-axial impeller vanes and outwardly extending helico-axial impeller vanes is appealing, the creation of such subassemblies is of necessity more complex than simply inserting the inner impeller into the vane-obstructed cavity 33 of the outer impeller. Nor, owing to the opposing nature of helico-axial impeller vanes 24 and 34, can the inner impeller be threaded into the outer impeller by rotating the inner impeller while inserting it into the outer impeller.

Figure 10:
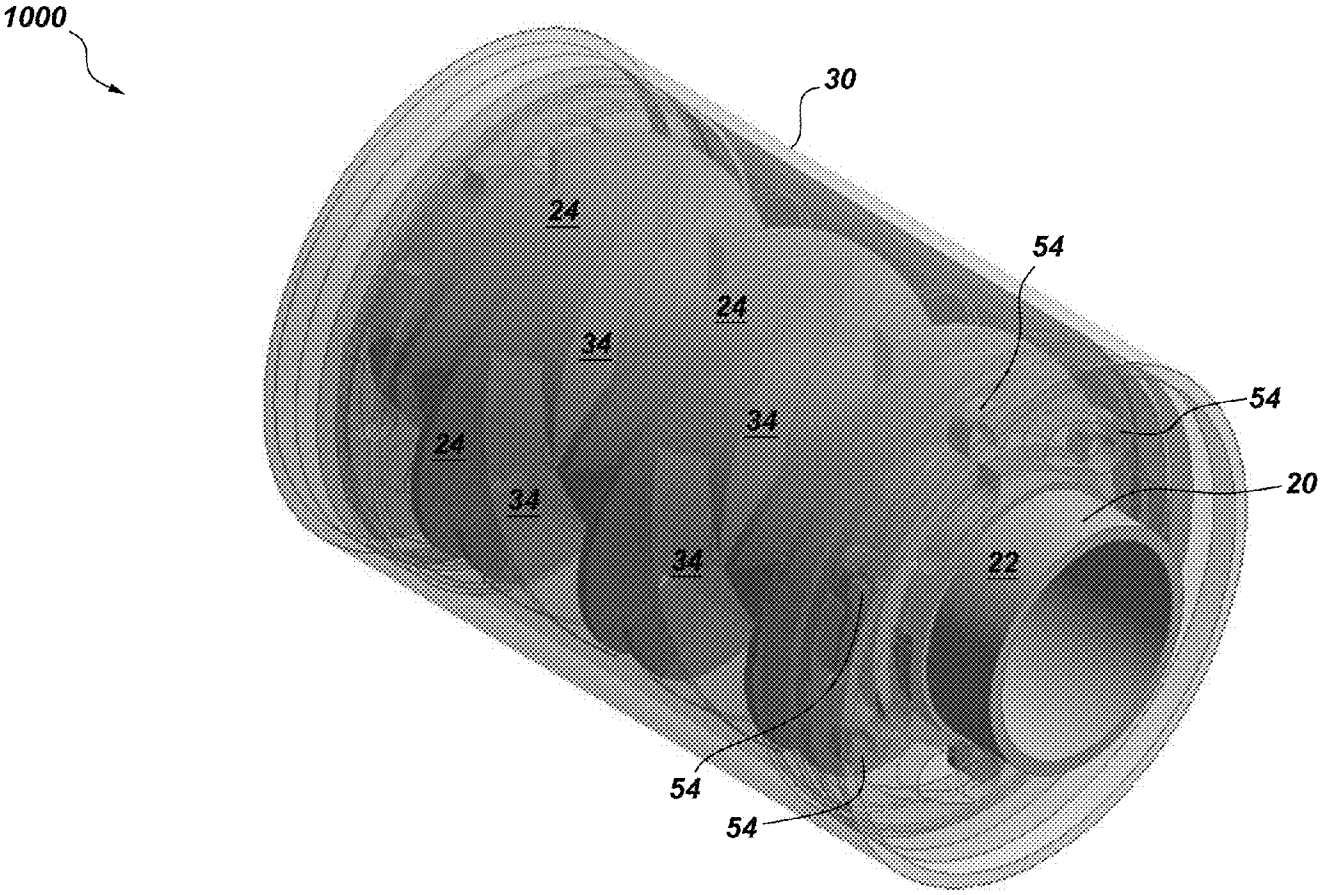
FIG. 10 illustrates a counter rotating helico-axial pump subassembly according to one or more embodiments of the present invention.

Referring to FIG. 10, the figure represents a view 1000 of a subassembly comprising the counter rotating helico-axial pump elements illustrated in FIG. 8 and FIG. 9.

Figure 11:
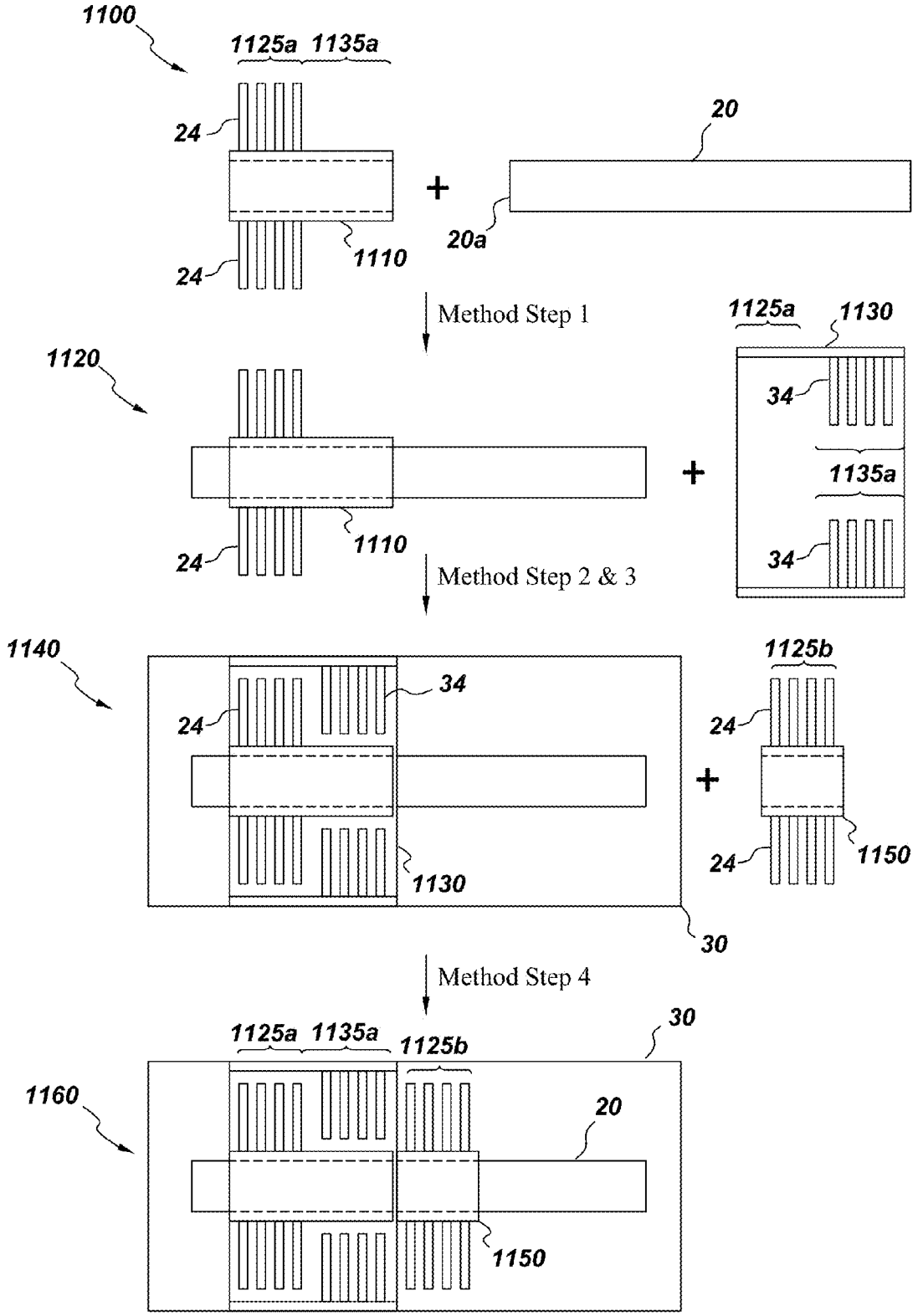
FIG. 11 illustrates a method of making a counter rotating helico-axial pump and pump assemblies according to one or more embodiments of the present invention.
Figure 12:
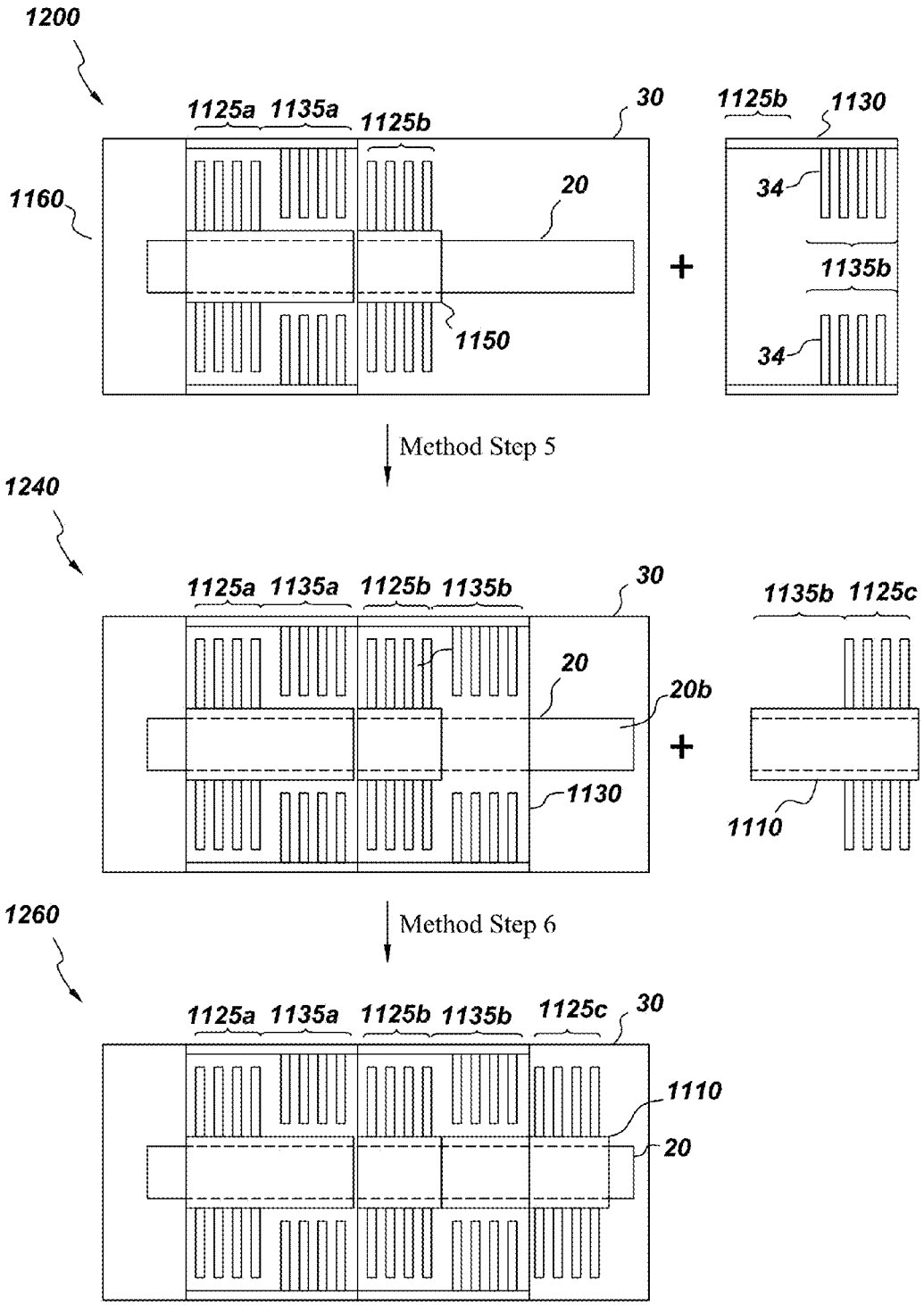
FIG. 12 illustrates a method of making a counter rotating helico-axial pump, pump assemblies, and a pump subassembly according to one or more embodiments of the present invention.

Referring to FIG. 11 and FIG. 12, the figures together illustrate key method steps in the construction of counter rotating helico-axial pumps, pump assemblies and pump subassemblies such as that shown in FIG. 10, according to one or more embodiments of the present invention. FIG. 11 illustrates method steps 1100 which may be used in the construction of counter rotating helico-axial pumps, counter rotating helico-axial pump assemblies and counter rotating helico-axial pump subassemblies. FIG. 12 illustrates additional method steps 1200 which may be used in the construction of such counter rotating helico-axial pumps, counter rotating helico-axial pump assemblies and counter rotating helico-axial pump subassemblies. The terms "assemblies" and "subassemblies" are distinguished in that an assembly is any combination of two or more counter rotating helico-axial pump components in any stage of completion, whereas a counter rotating helico-axial pump subassembly is recognizable as a complete subunit of the counter rotating helico-axial pump. Thus every "subassembly" will fall within the definition of an "assembly", but not all assemblies will qualify as subassemblies.

In a first step (method step 1) (FIG. 11), the method comprises inserting a first end 20*a* of an inner rotor 20 into a first sleeve 1110 comprising a first subset of outwardly extending helico-axial impeller vanes 24 disposed within a first zone 1125*a* to provide counter rotating helico-axial pump assembly 1120. The first sleeve further comprises a vane-free portion which extends the length of an adjacent zone 1135*a* configured to accommodate a first subset of inwardly extending helico-axial impeller vanes 34.

In a second step (method step 2), the assembly 1120 created in method step 1 is inserted axially into a cavity 33 (not shown) defined by a hollow outer rotor 30 initially comprising no helico-axial impeller vanes. This insertion of the inner rotor into the hollow outer rotor is such that the axis of rotation defined by the inner rotor is susceptible to becoming identical to the axis of rotation of the hollow outer rotor as additional pump components are added to the assembly.

In a third step (method step 3), a second sleeve 1130 comprising a first subset of inwardly extending helico-axial impeller vanes 34 is inserted into and joined to the inner surface 32 of the hollow outer rotor such that the inwardly extending helico-axial impeller vanes extend toward the vane-free portion 1135*a* of first sleeve 1110. The second sleeve 1130 further comprises a vane-free portion 1125*a* which extends the length of the adjacent zone occupied by the first subset of outwardly extending helico-axial impeller vanes 34. The vane-free portions of the first and second sleeves are configured to allow inwardly extending and outwardly extending helico-axial impeller vanes to rotate without contacting the surface of the corresponding vane-free portion.

In a fourth step (method step 4), a third sleeve 1150 comprising a second subset of outwardly extending helico-axial impeller vanes 24 disposed within a zone 1125*b* is joined to the outer surface of the inner rotor of assembly 1140 by mating a second end 20*b* of the inner rotor with third sleeve 1150 and moving the third sleeve along the length of the inner rotor until the third sleeve abuts the edge of or engages with the vane-free portion 1135*a* of the first sleeve 1110 to provide assembly 1160. In the embodiment shown in FIG. 11, third sleeve 1150 does not comprise a vane-free portion. In alternate embodiments of the method provided by the present invention, third sleeve 1150 comprises a vane-free portion.

In a fifth method step (method step 5), a fourth sleeve 1130 comprising a second subset of inwardly extending helico-axial impeller vanes 34 disposed within zone 1135*b* is inserted into and joined to the inner surface 32 of the hollow outer rotor 30 such that the inwardly extending helico-axial impeller vanes 34 extend toward the surface of inner rotor 20 and are adjacent to the second subset of outwardly extending helico-axial impeller vanes disposed within zone 1125*b*. The fourth sleeve 1130 further comprises a vane-free portion 1125*b* which extends the length of the adjacent zone occupied by the second subset of outwardly extending helico-axial impeller vanes 24 in zone 1125*b*. As will be appreciated by those of ordinary skill in the art, zone 1125*b* of fourth sleeve 1130 is configured to allow outwardly extending helico-axial impeller vanes 24 in zone 1125*b* of third sleeve 1150 to rotate without contacting the surface of the corresponding vane-free portion of fourth sleeve 1130.

In a sixth step (method step 6), a fifth sleeve 1110 comprising a third subset of outwardly extending helico-axial impeller vanes 24 disposed within a zone 1125*c* is joined to the outer surface of the inner rotor of assembly 1240 by mating a second end 20*b* of the inner rotor with fifth sleeve 1110 and moving the fifth sleeve along the length of the inner rotor until the fifth sleeve abuts the edge of or engages (or couples to) third sleeve 1150 to provide counter rotating helico-axial pump subassembly 1260. In the embodiment shown in FIG. 12, fifth sleeve 1110 comprises a vane-free portion 1135*b*. The vane-free portion 1135*b* of fifth sleeve 1110 is configured to allow inwardly extending helico-axial impeller vanes 34 of fourth sleeve 1130 to rotate without contacting the surface of the corresponding vane-free portion of fifth sleeve 1110.

Steps in addition to method steps 1-6 above which may be used to complete the assembly of a counter rotating helico-axial pump provided by the present invention include a seventh step (method step 7) of coupling either the inner rotor 20 or the hollow outer rotor 30 to a single driving device 40, for example an electric motor, which is configured to drive the rotor to which it is coupled, and an eighth step (method step 8) in which the assembly created in method steps 1-7 are fixed within a pump housing, for example a pump housing 80 (FIG. 5) equipped with bumper bearings 70 which fix the axial position of the hollow outer rotor 30 while allowing it to rotate around its axis. Single driving device 40 may also be fixed within the pump housing, for example, support structures such as struts.

The foregoing examples are merely illustrative, serving to illustrate only some of the features of the invention. The appended claims are intended to claim the invention as broadly as it has been conceived and the examples herein presented are illustrative of selected embodiments from a manifold of all possible embodiments. Accordingly, it is Applicants' intention that the appended claims are not to be limited by the choice of examples utilized to illustrate features of the present invention. As used in the claims, the word "comprises" and its grammatical variants logically also subtend and include phrases of varying and differing extent such as for example, but not limited thereto, "consisting essentially of" and "consisting of:" Where necessary, ranges have been supplied, those ranges are inclusive of all sub-ranges there between. It is to be expected that variations in these ranges will suggest themselves to a practitioner having ordinary skill in the art and where not already dedicated to the public, those variations should where possible be construed to be covered by the appended claims. It is also anticipated that advances in science and technology will make equivalents and substitutions possible that are not now contemplated by reason of the imprecision of language and these variations should also be construed where possible to be covered by the appended claims.

What is claimed is:

1. A counter rotating helico-axial pump comprising:

(a) an inner rotor comprising one or more outwardly extending helico-axial impeller vanes;

(b) a hollow outer rotor comprising one or more inwardly extending helico-axial impeller vanes;

(c) a single driving device configured to drive the inner rotor or the hollow outer rotor; and (d) a force transmission coupling joining the inner rotor and the hollow outer rotor and configured to permit rotation of the inner rotor and hollow outer rotor in opposite directions;

wherein at least a portion of the inner rotor is disposed within the hollow outer rotor, and wherein the inner rotor, the hollow outer rotor and the helico-axial impeller vanes define a fluid flow path, and wherein the inner rotor and hollow outer rotor are configured such that at least some of adjacent helico-axial impeller vanes are configured to rotate in opposite directions.

2. The counter rotating helico-axial pump according to claim 1, wherein the driving device drives the inner rotor.

3. The counter rotating helico-axial pump according to claim 1, wherein the driving device drives the hollow outer rotor.

4. The counter rotating helico-axial pump according to claim 1, wherein the force transmission coupling mechanically joins the inner rotor and the hollow outer rotor.

5. The counter rotating helico-axial pump according to claim 4, wherein the force transmission coupling is a planetary gear assembly.

6. The counter rotating helico-axial pump according to claim 1, wherein the force transmission coupling magnetically joins the inner rotor and the hollow outer rotor.

7. The counter rotating helico-axial pump according to claim 6, wherein the force transmission coupling is a magnetic gearbox assembly.

8. The counter rotating helico-axial pump according to claim 1, wherein there is no housing assembly.

9. The counter rotating helico-axial pump according to claim 1, not comprising a pump housing.

10. The counter rotating helico-axial pump according to claim 9, wherein the pump housing comprises an axial fluid inlet and axial fluid outlet.

11. A counter rotating helico-axial pump comprising:

(a) an inner rotor comprising one or more outwardly extending helico-axial impeller vanes;

(b) a hollow outer rotor comprising one or more inwardly extending helico-axial impeller vanes;

(c) a single driving device configured to drive the inner rotor or the hollow outer rotor; and (d) a force transmission coupling joining the inner rotor and the hollow outer rotor and configured to permit rotation of the inner rotor and hollow outer rotor in opposite directions;

wherein at least a portion of the inner rotor is disposed within the hollow outer rotor, and wherein the inner rotor, the hollow outer rotor and the helico-axial impeller vanes define a fluid flow path, and wherein the inner rotor and hollow outer rotor are configured such that at least some of adjacent helico-axial impeller vanes are configured to rotate in opposite directions, and wherein the inner rotor, the hollow outer rotor are disposed within a pump housing.

12. The counter rotating helico-axial pump according to claim 11, wherein at least some of adjacent helico-axial impeller vanes are configured to rotate in opposite directions, and at least some of at least some of adjacent helico-axial impeller vanes are configured to rotate in the same direction.

13. The counter rotating helico-axial pump according to claim 11, wherein the driving device drives the inner rotor.

14. The counter rotating helico-axial pump according to claim 11, wherein the driving device drives the hollow outer rotor.

15. The counter rotating helico-axial pump according to claim 11, wherein the force transmission coupling mechanically joins the inner rotor and the hollow outer rotor.

16. The counter rotating helico-axial pump according to claim 15, wherein the force transmission coupling is a planetary gear assembly.

17. The counter rotating helico-axial pump according to claim 11, wherein the force transmission coupling magnetically joins the inner rotor and the hollow outer rotor.

18. The counter rotating helico-axial pump according to claim 17, wherein the force transmission coupling is a magnetic gearbox assembly.

19. The counter rotating helico-axial pump according to claim 11, wherein the pump housing comprises an axial fluid inlet and axial fluid outlet.

20. The counter rotating helico-axial pump according to claim 11 wherein the force transmission coupling is configured to allow flow of a working fluid through a fluid flow path defined between the force transmission coupling and an inner wall section of the hollow outer rotor.

21. A counter rotating helico-axial pump comprising:

(a) an inner rotor comprising one or more outwardly extending helico-axial impeller vanes;

(b) a hollow outer rotor comprising one or more inwardly extending helico-axial impeller vanes;

(c) a single motor configured to drive the inner rotor; and (d) a force transmission coupling mechanically joining the inner rotor and the hollow outer rotor and configured to drive the hollow outer rotor in a direction of rotation opposite that of the inner rotor;

wherein at least a portion of the inner rotor is disposed within the hollow outer rotor, and wherein the inner rotor, the hollow outer rotor and the helico-axial impeller vanes define a fluid flow path, and wherein the inner rotor and hollow outer rotor are configured such that adjacent helico-axial impeller vanes are configured to rotate in opposite directions, and wherein the inner rotor, the hollow outer rotor, and the motor are disposed within a pump housing having an axial fluid inlet and an axial fluid outlet.

* * * * *